US005574202A

United States Patent [19]

Pilipski

[11] Patent Number: 5,574,202

[45] Date of Patent: Nov. 12, 1996

[54] TECHNIQUE FOR PROCESSING POISON GASES

[75] Inventor: Mark Pilipski, P.O. Box 561, Clifton, N.J. 07012

[73] Assignees: Mark Pilipski; Martin F. Sturman; Michael Ebert, all of Melrose Park, Pa.

[21] Appl. No.: 489,694

[22] Filed: Jun. 12, 1995

[51] Int. Cl.[6] ..... A62D 3/00

[52] U.S. Cl. ..... 588/200; 588/205; 588/206

[58] Field of Search ..... 588/200, 206, 588/205

[56] References Cited

U.S. PATENT DOCUMENTS 4,235,968 11/1980 Pilipski ..... 435/161
4,260,685 4/1981 Pilipski ..... 435/161
4,318,710 3/1982 Pilipski ..... 44/1 F
4,425,256 1/1984 Pilipski ..... 502/418
4,558,160 12/1985 Hydro ..... 564/261
5,387,717 2/1995 Puckett et al. ..... 564/295

*Primary Examiner*—Ngoclan Mai
*Attorney, Agent, or Firm*—Michael Ebert

[57] ABSTRACT

A technique for degrading a chemical warfare poison gas to render it innocuous. The toxic compound to be so treated is conducted through a reactor containing an anhydrous liquid halide which acts as a catalyst to degrade the toxic compound without yielding toxic effluents. The liquid halide is reclaimed and reintroduced into the reactor whereas the benign breakdown by-products are routed to other uses.

7 Claims, No Drawings

TECHNIQUE FOR PROCESSING POISON GASES

BACKGROUND OF INVENTION

1. Field of Invention

This invention relates generally to the disposal of poison gases of the type used in chemical warfare, and more particularly to a technique in which the poison gas to be treated is conducted through a bath of anhydrous liquid hydrogen chloride to render it innocuous.

2. Status of Prior Art

The first effective use of poison gas in chemical warfare took place in World War I when the Germans released chlorine gas against the Allies on the Western Front. Later, in the same war, the Germans introduced mustard gas.

Afterwards the major powers continued to stockpile poison gases for possible future use. Actual use of poison gas was made by the British in Afghanistan and by the French and Spanish in Africa. But during World War II lethal gases were not employed except by the Germans in concentration camps. However, lethal chemical gases are being stockpiled by many nations and in some instances are put to actual use. Thus mustard gas was used by Iraq during its war with Iran and also against Kurdish rebels.

Poison gases are roughly grouped according to their port of entry into the body and their physiological effects. Thus Lewisite like mustard gas, is a blistering agent which penetrates the skin and has fatal consequences. Nerve gases inhibit proper nerve function, while lung irritants attack the respiratory tract and cause pulmonary edema.

In 1990 at the end of the cold war, the U.S. and the USSR agreed to discontinue the production of poison gases and to sharply reduce their existing arsenal of these gases. The purpose of this agreement was to create a climate of change discouraging smaller nations from stockpiling such lethal weapons.

The concern of the present invention is with a technique usable with existing stockpiles of poison gases to render these gases innocuous. The need to detoxify existing stockpiles of poison gas is becoming increasingly urgent, for aging containers and facilities for storing these gases cannot survive the ravages of time and corrosion.

The several known chemical warfare gases, their chemical names, their mode of action and short-term and long-term toxic effects are set forth in the article "Disposing of the U.S. Chemical Weapons Stockpile" by Carnes and Watson in the JAMA Journal of August 1989 (Vo. 262, No.5).

Toxic compounds, such as Sarin, Mustard gas, VX and GB can be destroyed by pyrolysis or incineration. But in doing so there is a serious risk of producing toxic effluents. In a technique in accordance with the invention, these toxic gases are rendered innocuous by degradation in a reaction chamber filled with an anhydrous liquid halide without however producing toxic by-products.

My prior U.S. Pat. Nos. 4,235,968 and 4,260,685 disclose an auto-reaction utilizing feedstock cellulosic material and liquid anhydrous hydrogen chloride. The liquid anhydrous hydrogen chloride functions as a catalyst for the hydrolysis of the glycosidic bonds within the cellulose. The over-abundance of catalyst promotes this reaction even in the absence of free water molecules. The water for hydrolysis is donated by the cellulose. Hydrogen and hydroxy radicals are torn from the carbonaceous cellulose backbone and interposed between the oxygens of the glycosidic bonds. This reaction should not be confused with the established acid hydrolysis methods. The absence of free water and the over-abundance of halide catalyst make the chemistry quite distinct.

R—C—CH—CH—O—O—CH—CH—C—R converts to R—C—CH—CH—OH + HOO—CH—CH—C—R

This reaction takes place under very mild conditions. The conditions for this reaction may be altered by raising the temperature to ambient conditions, thereby causing the hetero oxygen bonds in the ring glucose units to also degrade. In summary this reaction causes almost all carbon-hetero-carbon and carbon-hetero-hetero bonds to rupture with the formation of hydroxyl, carboxylic, anhydride and similar side chains. We have found that these basic reactions can result in the degradation of certain highly toxic compounds such as VX, GB, Sarin and Mustard gas. The kinetics of these reactions are such that even molecules that might resist and reform during high temperature pyrolysis (incineration) will undergo rearrangement upon contact with the liquid halides. Also the sealed nature of the reaction vessel, to maintain pressure and the liquid state of the reactants, permits a continuous process in which as the toxic gases percolating through a bath of liquid anhydrous hydrogen chloride emerge as benign by-product components.

SUMMARY OF INVENTION

The main object of this invention is to provide a technique for processing chemical warfare compounds to render them innocuous without producing toxic effluents or other hazardous by-products.

More particularly an object of the invention is to provide a technique of the above type in which the compound to be treated is conducted through a reactor where it is subjected to a catalyst which degrades the compound. Hence a technique in accordance with the invention is relatively inexpensive for it does not make use of costly reagents which are consumed in the course of operation.

Briefly stated these objects are attained by conducting the toxic compound to be rendered innocuous through a reactor containing a bath of an anhydrous liquid halide which acts as a catalyst to degrade the toxic compound without yielding toxic effluents. The liquid halide is reclaimed and reintroduced into the reactor and the benign breakdown for by-products are routed to other uses.

DESCRIPTION OF INVENTION

The invention resides in a method of reacting any carbonaceous or organic chemical compound that contains carbonhetero or hetero-hetero bonds With ubiquitous water using an anhydrous halide as a catalyst. Ubiquitous water is defined as those water molecules that are naturally trapped in complex natural materials, such as wood and plant material, even after these materials have been 'air dried'; or water derived from various hydrogen and hydroxyl components of the molecules discussed. An example of this is a glucose molecule. Adjacent H— and HO— components on the carbon backbone are pulled free of the glucose molecule to act as if they were the components derived from a water molecule (HOH). Thus, defined as above, even an anhydrous compound may be considered to contain ubiquitous water available for this reaction.

The form of this reaction may be summarized as follows:

| Reactant | | Products |
|---|---|---|
| R−C−X−R + HCl | ⟶ | HCl + R−C−OH + HX−R |
| (HOH) | | + R−CH + HO−X−R |
| R−C−O−O−C−R | ⟶ | R−C−OH + HOOC−R |
| R−C−O−X−C−R | ⟶ | R−C−OH + HOX−C−R |
| R−C−Y−X−C−R | ⟶ | R−C−YH + HOX−C−R |

The relative proportion of the products varies with the nature of the X,Y and the R components; where R represents any chemical formula, C represents a carbon atom, and X and Y represent atoms other than carbon [most commonly oxygen, nitrogen, sulphur, or phosphorus]. The above reaction representatives may also be cyclic compounds where the R components are either directly or indirectly connected in the following manner:

| Reactant | | Products |
|---|---|---|
| R−C−X−R + HCl | ⟶ | HCl + HX−R−R−C−OH |
| | | + HO−X−R−R−CH |
| R−C−O−O−C−R | ⟶ | HOOC−R−R−C−OH |
| R−C−O−X−C−R | ⟶ | HOX−C−R−R−C−OH |
| R−C−Y−X−C−R | ⟶ | HOX−C−R−R−C−YH |

Reactions and reaction sequences that evolve similar final products are generally known as 'hydrolysis' reactions. Historically, hydrolysis reactions have been carried out by heated acid or caustic baths. Aqueous acids, such as hydrochloric acid, or aqueous caustics, such as sodium hydroxide, are boiled along with the initial compound to effect the addition of a water molecule across the susceptible bonds.

The acid hydrolysis of cellulose proceeds as below:

$$R-C-O-O-C-R + HOH \xrightarrow[\text{(hot acid catalyst)}]{} R-C-OH + HOOC-R$$

The acid hydrolysis and caustic hydrolysis of compounds containing carbon-hetero bonds proceeds as below:

$$R-C-X-C-R + HOH \xrightarrow[\text{(hot acid or hot caustic catalyst)}]{} \begin{matrix} R-C-OH + HX-C-R \\ R-C-H + HOX-C-R \end{matrix}$$

Although the initial and final products contain no ionic bonds, it appears that the formation of ionic components (by the acid or caustic) are an integral part of this reaction. Indeed this type of hydrolysis has not been shown to take place under non-ionic conditions.

A reaction in a technique in accordance with the invention is based upon the over-abundance of a very strong catalyst, The old technology, that of hot acid or hot caustic hydrolysis utilizes the hot acid or hot base to produce energetic ionic radicals within the solvent water. The reaction described herein relies upon the over-abundance of a very strong ion producing catalyst to produce energetic ionic radicals from whatever scant water molecules may be present in the reacting compounds.

These water molecules, or their equivalent acting chemical analogs, may even be created de novo from bits and pieces of the reacting compounds; as the hydrogen and hydroxyl side groups of the glucose molecule have been shown to provide the water for the breakdown of the glucose molecule by anhydrous liquid hydrogen chloride. The anhydrous liquid hydrogen chloride in fact acts as a solvent as well as catalyst for these reactions.

The known technology of hot acid hydrolysis or hot caustic hydrolysis requires large amounts of water relative to the reactant compounds. These methods also require a substantial amount of heat, usually applied to boil the acid or caustic bath. The use of liquid halides described herein eliminates the need for such quantities of heat. The reactions described using liquid anhydrous hydrogen chloride and cellulose as an example take place even under cryogenic conditions (−70° centigrade).

Further, the lack of free water in this technology makes these reactions far less corrosive to reaction vessels and pipes. The old hot acid or hot caustic methods are extremely corrosive to reaction vessels and pipes. The term 'caustic' is defined as 'capable of corroding.'

Using the old methodology of hot acid or hot caustic hydrolysis requires a substantial amount of time to convert the starting compounds to the product compounds of these reactions. As an example of this, the acid hydrolysis of cellulose requires boiling for several hours before even a small percent of the cellulose is converted to glucose. Using liquid anhydrous hydrogen chloride on a similar amount of cellulose requires only seconds to convert an equivalent amount of cellulose to glucose.

Another advantage of the use of anhydrous liquid halides over the old methodology is that the reactants and the products remain easily separable from the liquid halide. The prior aqueous technologies generally require several steps and processes to separate products from the aqueous solvents. This is due to the fact that many compounds that are subject to hydrolysis and many hydrolysis products have a high affinity for water, i.e. they are hygroscopic and hydrophilic. The dissimilar chemical and physical properties of liquid anhydrous halides and the reactants and the products of these reactions and the incorporation of any available water into the products permit easy separation of the products and the solvent halide.

Of the toxic gases under consideration, the presence of one or more very biologically reactive bonds combined with several very biologically inactive bonds enables these gases to react rapidly with biologic systems and interfere with normal biologic function. It is precisely the presence of these reactive bonds that allow for the breakdown of these compounds in accordance with the invention. GB contains O—C, O—P, P—C, and P:O bonds, each subject to hydrolytic breakdown. VX contains O—C, O—P, P—C, P:O, P—S, S—C, and N—C bonds, each subject to hydrolytic breakdown. Mustard contains S—C bonds that are subject to hydrolytic breakdown.

The construction of reaction vessels and piping to maintain and move liquid or gaseous anhydrous hydrogen chloride is well established. No new technology toward this end needs to be developed. Introduction of a gas or liquid reactant stream into a bath of liquid anhydrous hydrogen chloride from the product effluent stream may require some fractional condensation construction. Anhydrous hydrogen chloride has the physical properties of an inorganic substance and is quite distinct from most organic substances that might be expected in the effluent stream. Separation may be easily accomplished by a small temperature-pressure gradient. The reclaimed hydrogen chloride would be reintroduced into the main reaction vessel and the benign breakdown by-products would be routed to other uses.

The Merck Index contains a detailed description of the chemistry of known toxic gases such as Tabun, Soman, Mustard gas and Sarin. In these, gases ubiquitous water is represented by an analog of water. Thus in the case of Mustard gas, the analog of water ($H_2O$) is $H^2S$.

While there has been disclosed preferred embodiments of a technique in accordance with the invention, it is to be understood that many changes may be made therein without departing from the spirit of the invention.

I claim:

1. A technique for degrading a chemical warfare poison compound to render it innocuous, said technique comprising the steps of conducting the compound through a reactor containing an anhydrous liquid halide which acts as a catalyst to degrade the toxic compound, and withdrawing from the reactor the innocuous degraded compound.

2. A technique as set forth in claim 1, further including the step of withdrawing the catalyst from the reactor, reclaiming it, and returning it to the reactor.

3. A technique as set forth in claim 1, in which the anhydrous halide produces a hydrolysis reaction that utilizes the ubiquitous water in the compound to disrupt carbon-hetero or hetero-hetero chemical bonds.

4. A technique as set forth in claim 1, in which the poison compound is Mustard gas.

5. A technique as set forth in claim 1, in which the poison gas compound is Sarin.

6. A technique as set forth in claim 1, in which the halide is hydrogen chloride.

7. A technique as set forth in claim 6, in which the halide is at a cryogenic temperature.

* * * * *